US006063730A

United States Patent [19]

Simpson et al.

[11] Patent Number: 6,063,730

[45] Date of Patent: May 16, 2000

[54] REUSABLE DONOR LAYER CONTAINING DYE WELLS FOR CONTINUOUS TONE THERMAL PRINTING

[75] Inventors: William H. Simpson; Susan L. Dawson, both of Pittsford; Maurice L. Gray, Rochester, all of N.Y.; George W. Brock, La Jolla, Calif.

[73] Assignee: Eastman Kodak Company, Rochester, N.Y.

[21] Appl. No.: 09/136,724

[22] Filed: Aug. 19, 1998

[51] Int. Cl.[7] ..... B41M 5/035; B41M 5/38

[52] U.S. Cl. ..... 503/227; 428/304.4

[58] Field of Search ..... 8/471; 428/195, 428/913, 914, 212, 304.4, 421, 422, 473.5; 503/227

[56] References Cited

U.S. PATENT DOCUMENTS

| | | | |
|---|---|---|---|
| 4,661,393 | 4/1987 | Uchiyama et al. | 428/200 |
| 4,695,288 | 9/1987 | Ducharme | 8/471 |
| 4,737,486 | 4/1988 | Henzel | 503/227 |
| 5,137,382 | 8/1992 | Miyajima | 400/202.4 |
| 5,286,521 | 2/1994 | Matsuda et al. | 427/146 |
| 5,334,574 | 8/1994 | Matsuda et al. | 503/227 |
| 5,885,929 | 3/1999 | Brock et al. | 503/227 |

*Primary Examiner*—Bruce H. Hess
*Attorney, Agent, or Firm*—William F. Noval

[57] ABSTRACT

A reusable thermal dye donor element for a dye transfer thermal printer comprising: a base support having a plurality of wells which preferentially adsorb and desorb dye; and an overcoat on the base support which has a thickness less than the depth of the plurality of wells.

8 Claims, 3 Drawing Sheets

REUSABLE DONOR LAYER CONTAINING DYE WELLS FOR CONTINUOUS TONE THERMAL PRINTING

CROSS REFERENCE TO RELATED APPLICATIONS

This patent application claims the benefit under 35 USC §120 of the earlier filing date of U.S. patent application Ser. No. 08/877,387, filed Jun. 17, 1997.

FIELD OF THE INVENTION

This invention relates generally to thermal dye transfer printers and relates more particularly to such printers having a reusable dye donor member.

BACKGROUND OF THE INVENTION

As illustrated in FIG. 1, the major components of a thermal dye transfer printing system are:

1. The print head 10, which contains an array of discrete resistors to supply heat or electrodes to provide current with the heat generation via Joule heating.

2. The donor sheet 12 which consists of a thin base film carrying a dye material on one side and a slip layer on the side sliding against the print head. For Joule heating in the belt, a current return layer is required. The base has to be electrically conductive. Sheet 12 is fed between donor supply 11 and donor take-up 13.

3. A receiver material 14 (such as paper or transparency) in intimate contact with the dye side of the donor sheet.

4. A platen roller 16 required to form an intimate contact nip between the print head, the dye donor and image receiver, to enable transfer of the dye from the donor to the receiver, when the pulsed heat is generated either in the ribbon 12 or the print head 10.

FIG. 2 shows resistive ribbon printing where electrodes 18 inject current into the donor ribbon 20 where it heats the ink 22 and transfers it to the receiver 24.

A significant problem in this technology is that the dye donor members used to make the thermal prints are generally intended for single (one time) use. Thus, although the member has at least three times the area of the final print and contains enough dye to make a solid black image, only a small fraction of this dye is ever used.

After printing an image, the dye donor member cannot be easily reused, although this has been the subject of several patents. The primary reason that inhibits reuse of the dye donor members is that the dye transfer process is very sensitive to the concentration of dye in the donor layer. During the first printing operation, dye is selectively removed from the layer thus altering its concentration. In subsequent printings, regions of the donor member which had been previously imaged have a lower transfer efficiency than regions which were not imaged. This results in a ghost image appearing in subsequent prints.

The cost associated with having a single use donor ribbon is large because of the large area of ribbon required, as well as the large excess of dye remaining coated on the donor member. While this technology is able to produce high quality continuous tone color prints, it is desired to provide an approach which has all of the good attributes of thermal dye transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. The ink ribbon contains fine inorganic particles and low melting waxy materials to assist in the repeated use of this ribbon. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye and binder which limit the diffusion of dye out of the donor sheet. This enables the ribbon to be used to make multiple prints. This enables the ribbon to be used to make multiple prints. The binder provides the medium through which the dye diffuses. Since the mass of dye is transferred by diffusion a continues tone can be achieved by heating the dye/binder to several levels of temperature thus providing a plurality of density levels in the print.

The cross-referenced application discloses a printing engine which includes a reusable thermal dye donor element having a base layer, and a donor layer on the base layer which contains wells which preferentially adsorb and desorb dye. The advantages of the invention described are a reusable dye donor element which reduces cost and complexity in addition to the minimization of environmental issues by a significant reduction in waste product. The reusable belt described contains the wells entirely within one layer such that the thickness of the pore layer is that necessary to act as a well. The description of the reusable belt indicates that a binder for the dye is not necessary. It would be anticipated by one familiar with the state of the art that an oleophilic dye contained in the well, when fused by heat, would behave in a manner similar to that of a mass transfer system. That is, the transfer of the dye mass would be binary since the dye is either in a fused state or unfused state. In this case, it would require a half-tone printing method to produce prints which have a plurality of density levels.

SUMMARY OF THE INVENTION

According to the present invention, there is provided a solution to the needs discussed above.

According to an aspect of the present invention, there is provided a reusable thermal dye donor element for a dye transfer thermal printer comprising: a base support having a plurality of wells which preferentially adsorb and desorb dye; and an overcoat on the base support which has a thickness less than the depth of the plurality of wells.

According to another aspect of the present invention, there is provided a thermal dye transfer printing system comprising: a reusable thermal dye donor element including a base support having a plurality of wells which preferentially adsorb and desorb dye, and an overcoat on the base support which has a thickness less than the depth of the plurality of wells; a printing station at which dye is image-wise transferred from the dye donor element to a receiver medium, at least partially depleting the dye donor element of dye; and a dye replenishment station for replenishing dye which has been depleted from the donor element wells.

ADVANTAGEOUS EFFECT OF THE INVENTION

The invention has the following advantages.

1. The dye donor element in a thermal printing system can be reused, reducing cost and complexity of the system.

2. Environmental issues are minimized by a significant reduction in waste product.

3. A continuous tone image of improved density and dynamic range is obtained instead of a binary one.

DETAILED DESCRIPTION OF THE INVENTION

Figure 1:
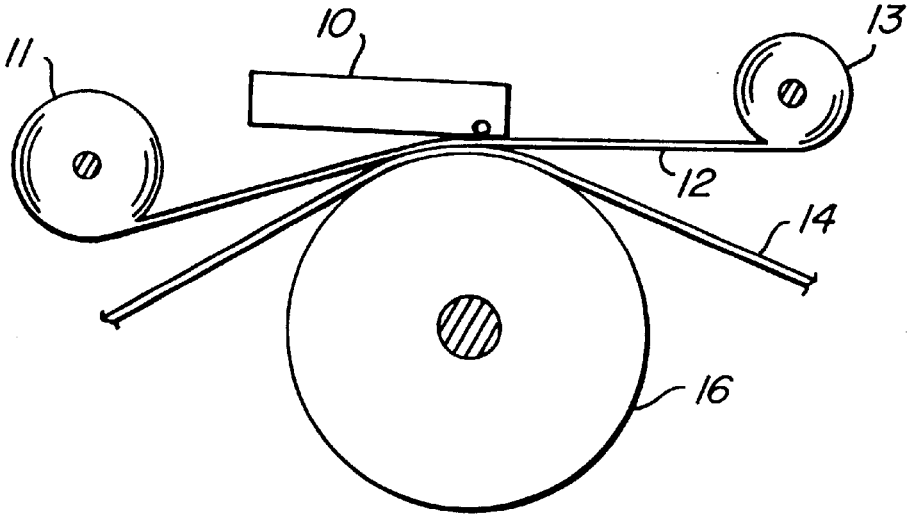
FIG. 1 is a diagrammatic view of a conventional resistive head thermal printing system.
Figure 2:
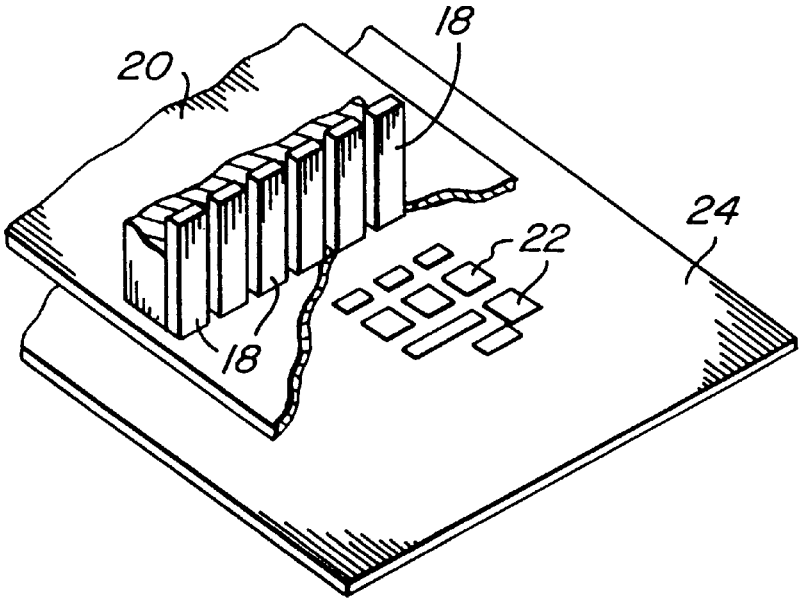
FIG. 2 is a perspective diagrammatic view of a resistive ribbon thermal printing system.
Figure 3:
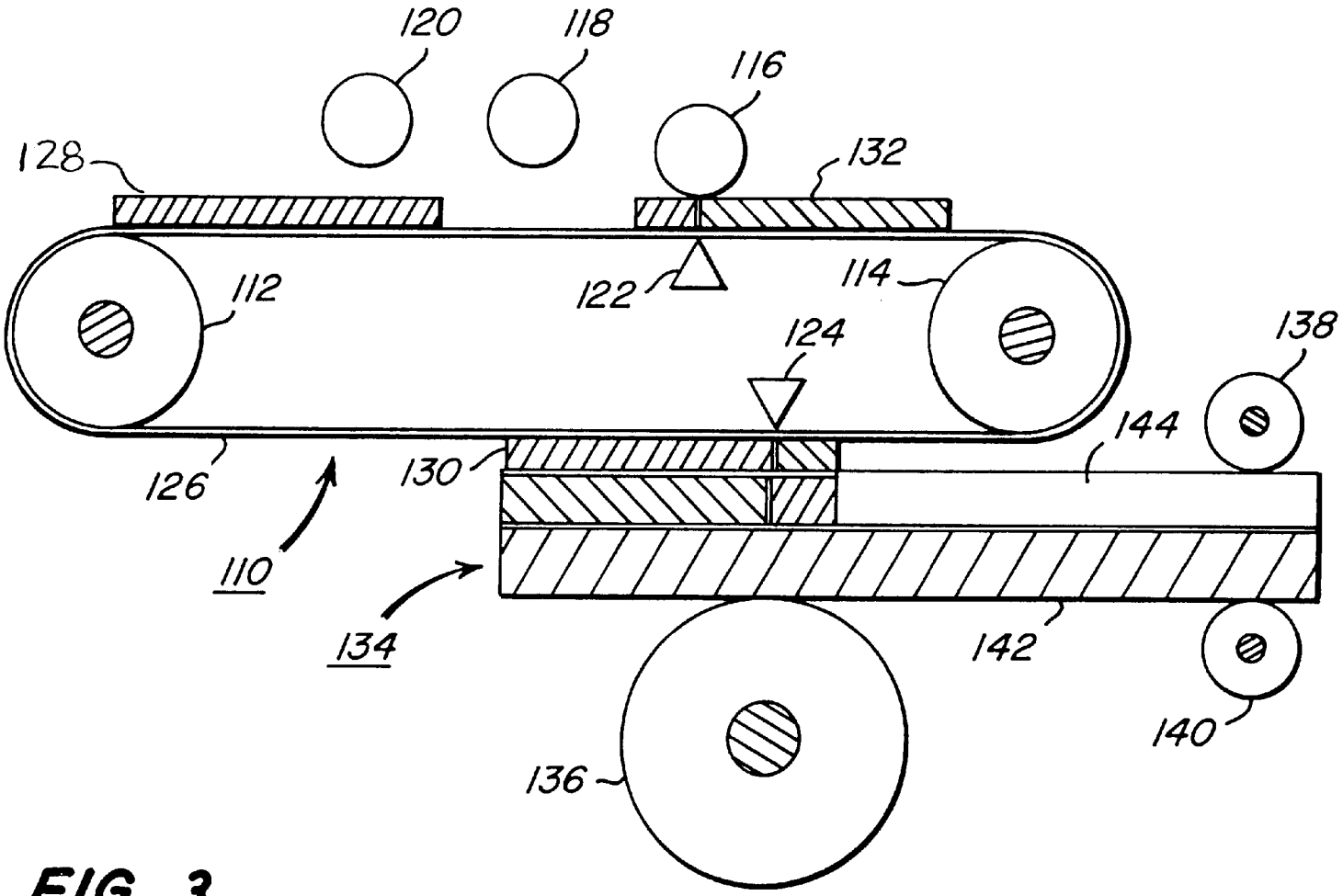
FIG. 3 is a diagrammatic side view of a reusable dye donor element and thermal printing system.

Referring to FIG. 3, there is shown a reusable dye donor element, such as in the form of a belt 110 that is trained about a pair of rollers 112 and 114. At least one of the two rollers is driven to advance belt 110 past a plurality of dye reservoir rollers 116, 118, and 120; one or more re-ink heads 122; and a printhead 124 at a printing station.

Donor member belt 110 comprises a support 126 and a dye donor element such as a plurality of dye donor patches 128, 130, and 132. Any material can be used as the support for the dye-donor element of the invention provided it is dimensionally stable and can withstand the heat generated. Such materials include aluminum or other metals; polymers loaded with carbon black; metal/polymer composites such as polymers metalized with 500–1000 Å of metal; polyesters such as polyethylene terephthalate, polyethylene naphthalate, etc.; polyamides (such as nomex); polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 $\mu$m to about 200 $\mu$m and may also be coated with a subbing layer, if desired, such as those materials described in U.S. Pat. Nos. 4,695,288 or 4,737,486.

In the illustrated embodiment, the dye donor element forms a distinct dye donor patch on the support for each color. However, a continuous dye donor element over the entire support surface may be used, with machine logic subdividing the single element into dedicated color regions. Likewise, more than three patches may be used. (The dye donor element is described below with respect to FIG. 4.)

Referring again to FIG. 3, conventional dye receiver medium 134 is drawn through a nip formed between printhead 124 and a platen roller 136 by a capstan drive roller pair 138 and 140. Dye receiver medium 134 is conventional, and includes a support 142 and a receiving layer 144. Image-wise activation of linear printhead 124 causes dye to be transferred from the dye donor element of belt 110 into the dye receiving layer 144 of medium 134; at least partially image-wise depleting portions of the patches of dye.

Dye reservoir rollers 116, 118, and 120 include a permeation membrane. Examples of membrane material include cellulose and derivatezed cellulose used alone or blended with other components, polyesters, polyamides, polysufone, crosslinked polystyrene, phenol/formaldehyde resin and fluorinated polymers to include polytetrafluoroethuylene and polyvinylidene fluoride, polycarbonate, poly(vinyl alcohol) and silicon containing polymers. Membranes can be constructed from a dense layer of polymer supported on a porous sub-layer. These polymeric membranes can be crosslinked to further reduce permeability.

Dye reservoir rollers 116, 118, and 120 may be replaced by wicks formed of similar materials, but not mounted for rotation.

Each dye reservoir roller is opposed by a re-ink head 122 (only one head is illustrated in the drawing), and the rollers are selectively raised and lowered into contact with belt 110 as necessary. When a dye reservoir roller is lowered to the belt, and the associated re-ink head activated, heat and/or pressure between the dye reservoir roller and belt 110 effects re-inking of the dye donor element, and the depleted dye donor layer of the patch is re-saturated with dye from the dye reservoir roller.

In this method, dye is thermally transferred from a reservoir to the depleted donor patch. The dye and a carrier are contained in the reservoir. The reservoir is covered with a diffusion controlled permeation membrane. With the addition of heat dye diffuses through the membrane and is delivered to the donor patch. The dye partitions between the reservoir and the donor patch reestablishing the original dye concentration.

Figure 4:
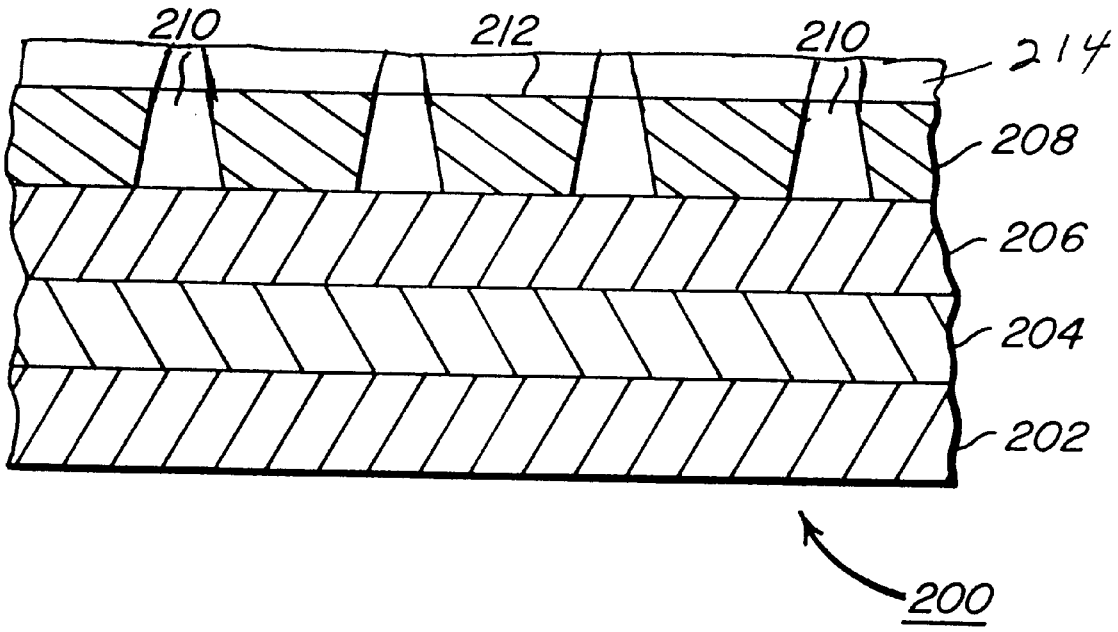
FIG. 4 is a diagrammatic side view of a segment of the dye donor element of FIG. 3.

FIG. 4 shows the structure of the dye donor element according to the invention. As shown, dye donor element 200 includes 1. A slip layer 202,
2. A base film (such as polyimide) 204,
3. An under-layer 206,
4. A pore layer 208 having wells 210, and
5. An overcoat layer 214.

In one embodiment, using an oil based dye formulation, the under-layer 206 is a very thin layer of oleophilic material. The thickness of the pore layer 208 is that necessary to act as a well for the resulting design, and pore layer material is oleophobic.

In another embodiment, the alternate situation is where the dye formulation is water based and the top surface of the under-layer 206 is wetted by water (oleophobic) and the surface of the pore layer 208 is not wetted by water (oleophobic).

The under-layer 206 may be metal, metal oxide, or polymer. It can provide the current return path for a resistive ribbon printing system. The pore-layer 208 is a polymer that has wells 210 formed through it to expose the surface of layer 206. It is preferably a hard wearing surface, that can be coated and is initially non cross-linked, and can have holes formed through it, and then heated to cross link it. Alternatively, the pore material 208 may be a UV curable system and after the well formation, is cross-linked by UV radiation.

Methods of forming the wells 210 in pore material 208 include:

a) laser ablation down to the surface of layer 206, which should be chosen to be non-absorbing by the laser beam wave length.

b) the pore layer surface 212 can be coated with photoresist and exposed to arrays of wells through masking, through which chemical attack forms holes in the pore layer 208, and the photoresist in subsequently removed. It is possible that layer 208 itself could be photoresist, which after well formation through it, can be heat or UV cross linked to form a wear resistant surface.

The dimensions of the well can be controlled by the pore-layer 208 thickness, and well diameter. The degree of surface tension from well capillary action and surface wetting at the well bottom is controlled by the diameter of the well, these must be balanced against the dye properties to attract sufficient dye into the wells in layer 208. The well pitch can be determined from dye requirements for printing.

Overcoat layer 214 can be a polyimide layer having a thickness less than layer 208.

Following is a more detailed description of the present invention.

A. Laser Indented Donor Support:

Control Example 1 consists of a polyimide sheet (Kapton® sheet (E.I. DuPont de Nemours)) approximately 0.002 inches thick which has been indented by the procedure discussed below. The wells or blind holes are placed in a close-packed hexagonal array. The holes are 2 microns deep and approximately 7 microns in diameter. The wells are filled with Dye mixture "A".

Control Example 2 is the same as Control Example 1 except that the holes are 1 micron deep and 5 microns in diameter.

Control Example 3 is the same as Control Example 2 except that it was filled with Dye mixture "B".

Invention Example 1 consists of the same polyimide sheet as Control Example 1 except that the sheet has been overcoated with a polytetrafluoroethylene polymer (PTFE) (Teflon® polymer(120FN 616 from DuPont)). The size of the wells and dye mixture used are the same as that in Control Example 1.

Invention Example 2 consists of the same polyimide sheet as Control Example 2 except that the sheet has been overcoated with a PTPE polymer. The size of the wells and dye mixture used are the same as that in Control Example 2.

Invention Example 3 is the same sample as that used in Invention Example 2 except that the dye-filled, indented donor was treated with a fusing step (vide infra-printing) prior to actually printing the dye to a thermal dye receiver.

Invention Example 4 consists of the same polyimide sheet as Control Example 3 except that the sheet is overcoated with a PTFE polymer. The size of the wells and dye mixture used are the same as that in Control Example 3.

B. Procedure for preparing wells in donor support

The well-patterned polyimide donor used in the printing experiments was produced using photolithography and ion etching. The PTFE coated polyimide sample was laminated to a silicon wafer and coated to a thickness of 2 microns with Hoechst-Celanese AZ 1518 photoresist. The hole pattern was exposed on the photoresist through a mask, using a standard photoresist aligner, and holes developed through the photoresist coating. The resulting photoresist surface was ion-milled for a sufficient time to produce one micron deep, blind holes (wells) through the PTFE into the polyimide surface. The remaining photoresist was stripped off the milled polyimide surface and the samples removed from the silicon wafer. Each sample was prepared in a similar manner regardless of composition. The holes or wells can be placed in the sample using many different designs, such as a linear array or close-packed hexagonal.

C. Procedure for filling wells with dye

Dye Mixture "A" was prepared by blending 21 weight percent Dye 1, 29% Dye 2 and 50% Dye 3 into a homogenous mixture.

Dye Mixture "B" was prepared by blending 23 weight percent Dye 3, 39% Dye 4, 38% Dye 5 into a homogenous mixture A laboratory hot-plate (PL-351 from Corning, Inc.) was used to heat the sample of indented donor to between 125 and 135 degrees Celsius. A copper plate (8"×10"×1") was placed on top of the hot plate. A glass plate (6×6×½") was then placed over the copper plate. The indented donor was cut to 1×3 inches and taped to a glass microscope slide with the empty wells facing outward. The glass slide with mounted donor was heated on the hot plate assembly above. A small amount of either Dye Mixture "A" or "B" was placed on the face of the indented donor and allowed to fuse. The fused dye was spread evenly over the surface with a wooden spatula. The excess dye mixture was removed from the surface by wiping with a clean, cotton cloth while the donor remained on the hot plate assembly. The sample was removed from the hot plate assembly and allowed to cool. After cooling the cleanliness of the surface and filling of the wells was evaluated by optical microscopy. The surface was found to be clean of excess dye and the wells filled. The resulting samples were then printed to a thermal dye receiver using the procedure below.

While the procedure above represents a manual method for filling the indented donor with dye it should be obvious to one skilled in the state of the art that automated mechanical and electrical methods can be devised to accomplish the same purpose.

D. Procedure for printing dye filled donor support to receiver

All images made with the dye-filled, laser indented donors were printed under identical conditions. Each of the thermally transferred reflection images was composed of a step wedge gradient printed down the length of the receiver. An X-Rite densitometer (X-Rite Inc., Grandville, Mich.) measuring Status A reflection density was used to determine differences in printing efficiency.

The imaged prints were prepared by placing the indented dye-donor element which had been filled with dye previously, in contact with the polymeric receiving layer side of the receiver element. A Mylar® (E.I. DuPont de Nemours) substrate six micrometers thick with a slipping layer was placed over the indented donor such that the slipping layer is in contact with the thermal print head. The entire assemblage was fastened to the top of the motor driven 53 mm diameter rubber roller and a TDK thermal head L-231, thermostated at 30° C. with a head load of 2.5 Kg pressed against the rubber roller. (The TDK L-231 thermal print head has 512 independently addressable heaters with a resolution of 5.4 dots/mm and an active printing width of 95 mm, of average heater resistance 501 ohms). The imaging electronics were activated and the assemblage was drawn between the printing head and roller at 20.6 mm/sec. Coincidentally, the resistive elements in the thermal print head were pulsed on for 114 microseconds every 130 microseconds. Printing maximum density requires 128 pulses "on" time per printed line of 17 msec. The images were printed with a 1:1 aspect ratio. The maximum printing energy was 10.2 J/cm$^2$.

A fusing step was employed in one experiment where the applied voltage on the print head was raised to 13 volts. At the same time the resistive elements were pulsed on for 128 microseconds every 130 microseconds. The fusing energy was 19.3 J/cm$^2$.

E. Receiver formulation

The dye receiving element consisted of a subbed reflective base material, as described in U.S. Pat. No. 5,244,861, coated with a dye-receiving layer comprising Makrolon®KL3-1013 (Bayer AG) (1.71 g/m$^2$) and Lexan 141® (General Electric Co.) (1.40 g/m$^2$), Drapex 429® (Witco) (0.26 g/m$^2$), diphenylphthalate (Eastman Kodak Co.) (0.52 g/m$^2$), Fluorad FC-431® (3M Corp.) (0.012 g/m$^2$) was coated from dichloromethane. This receiver layer was overcoated with a polymeric layer consisting of KGH (50)HA(6.5wt %)PDMS (Eastman Kodak Co.) (0.66 g/m$^2$), KGH(50)HA polyol (Eastman Kodak Co.) (0.108 g/m$^2$), Fluorad FC-431® (0.022 g/m$^2$) and DC-510 (Dow Corning Co.) (0.0027 g/m$^2$) dissolved in dichloromethane.

TABLE I

Status A Density of Step Wedge Image with Dye Mixture "A"

| Steps | Control Example 1 | Invention Example 1 Overcoat | Control Example 2 | Invention Example 2 Overcoat | Invention Example 3 Overcoat |
|---|---|---|---|---|---|
| 1 | 1.38 | 2.23 | 1.35 | 2.05 | 1.57 |
| 2 | 1.29 | 2.10 | 1.26 | 1.89 | 1.21 |
| 3 | 1.15 | 1.70 | 1.12 | 1.47 | 1.01 |
| 4 | 0.21 | 1.40 | 1.00 | 0.86 | 0.77 |
| 5 | 0.17 | 0.97 | 0.40 | 0.59 | 0.60 |
| 6 | — | 0.64 | 0.17 | 0.28 | 0.37 |
| 7 | — | 0.19 | — | 0.17 | 0.19 |
| 8 | — | 0.13 | — | — | 0.05 |

TABLE II

Status A Density of Step Wedge Image with Dye Mixture "B"

| | Control Example 3 | | | Invention Example 4 Overcoat | | |
|---|---|---|---|---|---|---|
| Steps | Red | Green | Blue | Red | Green | Blue |
| 1 | 0.92 | 1.08 | 1.17 | 1.95 | 2.34 | 2.46 |
| 2 | 0.60 | 0.72 | 0.79 | 1.28 | 1.76 | 2.06 |
| 3 | 0.20 | 0.29 | 0.33 | 1.12 | 1.53 | 1.82 |
| 4 | 0.11 | 0.15 | 0.15 | 0.59 | 0.79 | 0.92 |
| 5 | 0.09 | 0.12 | 0.12 | 0.37 | 0.49 | 0.58 |
| 6 | | | | 0.24 | 0.32 | 0.38 |
| 7 | | | | 0.16 | 0.19 | 0.21 |
| 8 | | | | 0.14 | 0.16 | 0.17 |

It can be seen from Table I that Invention 1 Examples 1 and 2 have higher maximum densities and a larger number of steps compared to Control Examples 1 and 2, respectively, when printed under the same conditions. The results indicate that placing a PTFE coating on the polyimide substrate improves the printed Status A density when the wells are filled with Dye Mixture "A". Invention Example 3 has two additional steps when compared to Control Example 2 which indicates that fusing the filled, indented donor gives a longer dynamic range.

It can be seen from Table II that Invention Example 4 has a significantly higher density and a larger number of steps than Control Example 3. The results indicate that placing a PTFE coating on the polyimide substrate improves the printed density and number of steps when the wells are filled with Dye Mixture "B".

DYES 1–5

DYE 1

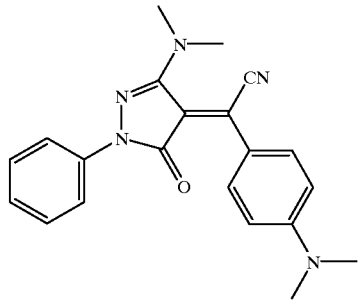

MM2500ELJ
KAN 588963

DYE 2

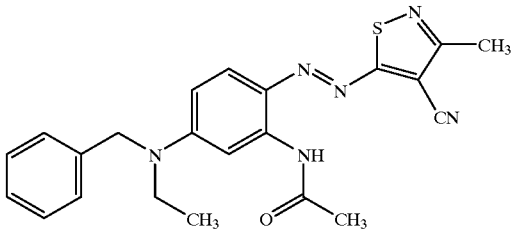

MM2500DYH
KAN 564453

-continued

DYE 3

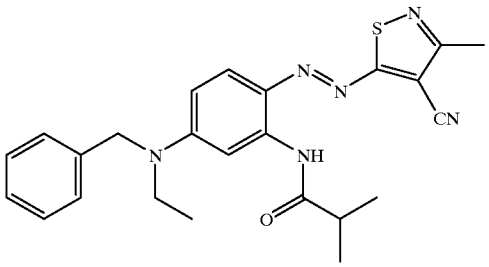

MM2500EVV
KAN 575243

DYE 4

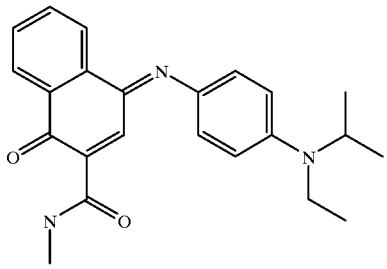

114FN-D91Q
KAN 621079

DYE 5

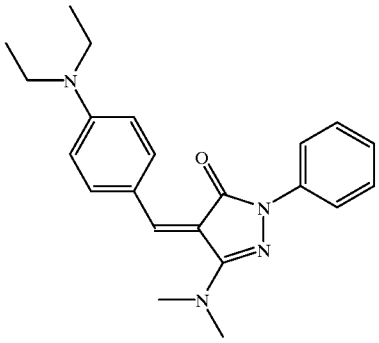

MY2500EMC
KAN 589481

The invention has been described in detail with particular reference to certain preferred embodiments thereof, but it will be understood that variations and modifications can be effected within the spirit and scope of the invention.

| PARTS LIST | |
|---|---|
| 10 | print head |
| 11 | donor supply |
| 12 | donor sheet |
| 13 | donor take-up |
| 14 | receiver material |
| 16 | platen roller |
| 18 | electrodes |
| 20 | donor ribbon |

-continued

| PARTS LIST | |
|---|---|
| 22 | ink |
| 24 | receiver |
| 110 | donor member belt |
| 112,114 | rollers |
| 116,118,120 | dye reservoir rollers |
| 122 | re-ink heads |
| 124 | print head |
| 126 | support |
| 128,130,132 | dye donor patches |
| 134 | dye receiver medium |
| 136 | platen roller |
| 138,140 | capstan drive roller pair |
| 142 | support |
| 144 | receiving layer |
| 200 | dye donor element |
| 202 | slip layer |
| 204 | base film |
| 206 | under-layer |
| 208 | pore layer |
| 210 | wells |
| 212 | pore layer surface |

What is claimed is:

1. A reusable thermal dye donor element for a dye transfer thermal printer comprising:

a base support with donor structure having a plurality of wells which preferentially adsorb and desorb dye; and an overcoat on said base support which has a thickness less than the depth of said plurality of wells.

2. The donor element of claim 1 wherein said base support is a polyimide.

3. The donor element of claim 1 wherein said base support includes a base layer and a donor layer having said plurality of wells.

4. The donor element of claim 1 wherein said overcoat is of polytetrafluoroethylene.

5. The donor element of claim 1 wherein said plurality of wells have dye incorporated into said wells without a binder.

6. The donor element of claim 5 wherein said dye is fused in said wells.

7. The donor element of claim 1 including a slip layer on said base support.

8. A thermal dye transfer printing system comprising:

a reusable thermal dye donor element including a base support with donor structure having a plurality of wells which preferentially adsorb and desorb dye, and an overcoat on said base support which has a thickness less than the depth of said plurality of wells;

a printing station at which dye is image-wise transferred from said dye donor element to a receiver medium, at least partially depleting the dye donor element of dye; and a dye replenishment station for replenishing dye which has been depleted from said donor element wells.

* * * * *